US010465712B2

(12) United States Patent
Freeman

(10) Patent No.: US 10,465,712 B2
(45) Date of Patent: Nov. 5, 2019

(54) ANTI-ROTATION STATOR VANE ASSEMBLY

(71) Applicant: United Technologies Corporation, Farmington, CT (US)

(72) Inventor: Thomas Freeman, Kennebunk, ME (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 420 days.

(21) Appl. No.: 15/270,773

(22) Filed: Sep. 20, 2016

(65) Prior Publication Data

US 2018/0080477 A1 Mar. 22, 2018

(51) Int. Cl.

| | |
|---|---|
| ***F04D 29/64*** | (2006.01) |
| ***F04D 29/52*** | (2006.01) |
| ***F04D 29/54*** | (2006.01) |
| ***F01D 9/04*** | (2006.01) |
| ***F01D 25/24*** | (2006.01) |

(52) U.S. Cl.

CPC ..... *F04D 29/644* (2013.01); *F01D 9/042* (2013.01); *F01D 25/246* (2013.01); *F04D 29/522* (2013.01); *F04D 29/542* (2013.01); *F05D 2230/60* (2013.01); *F05D 2240/1281* (2013.01); *F05D 2240/80* (2013.01)

(58) Field of Classification Search

CPC ... F01D 9/02; F01D 9/04; F01D 9/042; F01D 25/24; F01D 25/246; F04D 29/522; F04D 29/542; F04D 29/64; F04D 29/644; F05D 2230/60; F05D 2240/80; F05D 2240/1281

USPC ..... 29/889.22

See application file for complete search history.

(56) References Cited

U.S. PATENT DOCUMENTS

| | | | | |
|---|---|---|---|---|
| 6,409,472 | B1 * | 6/2002 | McMahon | F01D 5/3023 415/119 |
| 2005/0111969 | A1 | 5/2005 | Arness | |
| 2013/0209248 | A1 * | 8/2013 | Ring | F01D 25/246 415/209.3 |
| 2014/0033734 | A1 * | 2/2014 | Lockhart | F04D 29/542 60/796 |

(Continued)

FOREIGN PATENT DOCUMENTS

| | | |
|---|---|---|
| DE | 102007001459 | 7/2007 |
| EP | 3000980 | 3/2016 |

OTHER PUBLICATIONS

European Patent Office, European Search Report dated Mar. 13, 2018 in Application No. 17185642.0-1006.

*Primary Examiner* — Christopher Verdier
*Assistant Examiner* — Elton K Wong
(74) *Attorney, Agent, or Firm* — Snell & Wilmer, L.L.P.

(57) ABSTRACT

A vane assembly may comprise an engine case and an anti-rotation lug coupled to the engine case. The anti-rotation lug may have a forward end and an aft end. A vane cluster may be supported within the engine case. The vane cluster may include an outer shroud with a first slot defined by a forward flange of the outer shroud and with a second slot defined by an aft flange of the outer shroud. The second slot may be configured to receive the aft end of the anti-rotation lug from first direction and wherein the aft flange may be configured to block receipt of the anti-rotation lug from a second direction, which is opposite the first direction.

15 Claims, 9 Drawing Sheets

(56) References Cited

U.S. PATENT DOCUMENTS

2014/0219791 A1* 8/2014 Richardson ..... F01D 25/246
415/209.2
2016/0298647 A1* 10/2016 Hudson ..... F01D 9/042

* cited by examiner

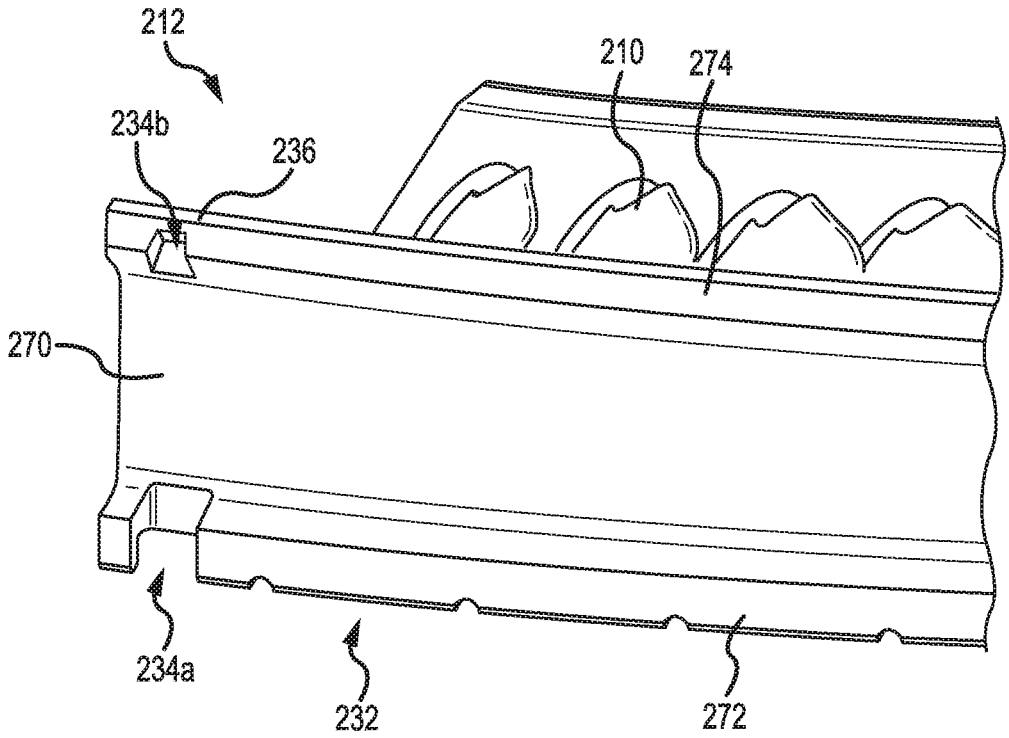
FIG.3C
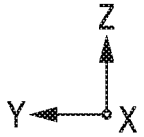

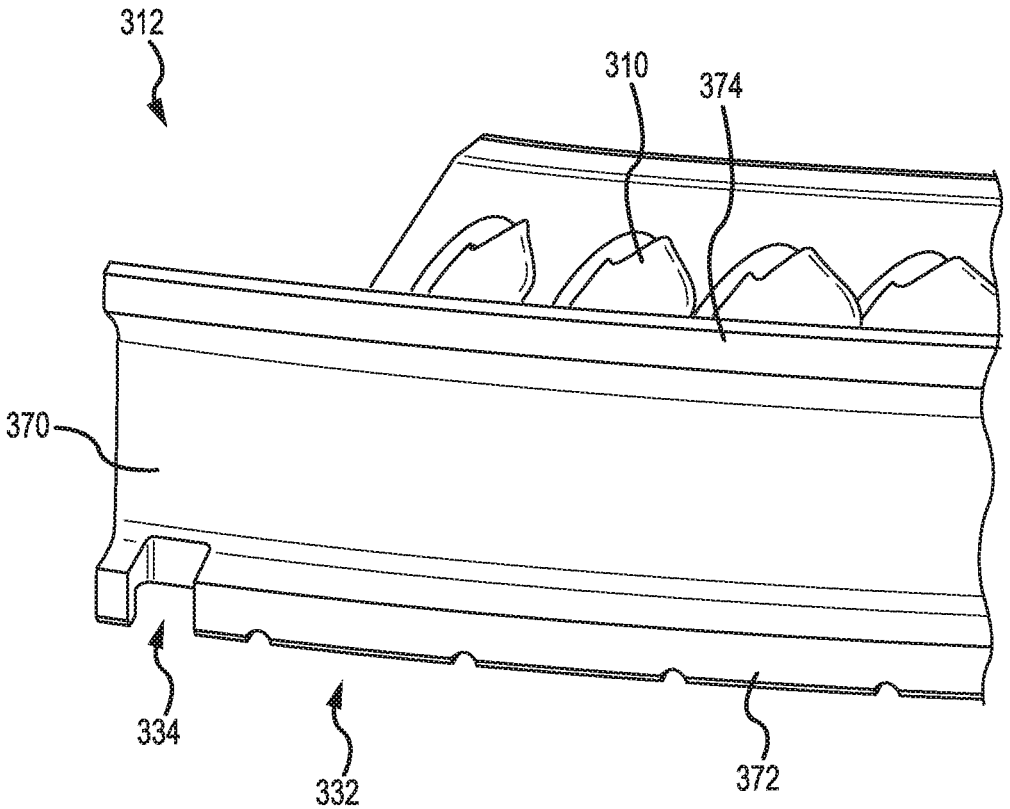
FIG.3D
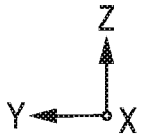

ANTI-ROTATION STATOR VANE ASSEMBLY

FIELD

The present disclosure relates to a gas turbine engine and, more specifically, to a stator vane assembly.

BACKGROUND

Gas turbine engines typically include a fan section, a compressor section, a combustor section and a turbine section. In general, during operation, air is pressurized in the compressor section and is mixed with fuel and burned in the combustor section to generate hot combustion gases. The hot combustion gases flow through the turbine section, which extracts energy from the hot combustion gases to power the compressor section and other gas turbine engine loads. One or more sections of the gas turbine engine may include a plurality of vane assemblies having vanes interspersed between rotor assemblies that carry the blades of successive stages of the section. Each vane assembly may comprise a plurality of a vanes installed within an engine case to form an annular structure. Installation of vane assemblies is prone to human error.

SUMMARY

A vane assembly for a gas turbine engine is described herein, in accordance with various embodiments. A vane assembly may comprise an engine case and an anti-rotation lug coupled to the engine case. The anti-rotation lug may have a forward end and an aft end. A vane cluster may be supported within the engine case. The vane cluster may include an outer shroud with a first slot defined by a forward flange of the outer shroud and with a second slot defined by an aft flange of the outer shroud. The second slot may be configured to receive the aft end of the anti-rotation lug from first direction and wherein the aft flange may be configured to block receipt of the anti-rotation lug from a second direction, which is opposite the first direction.

In various embodiments, a width of the second slot may be less than a width of the anti-rotation lug. The second slot may include a tapered opening. The aft end of the anti-rotation lug may include a tapered geometry and is configured to fit into the tapered opening of the second slot. An aft edge of the aft flange may form an aft wall of the second slot. The vane cluster may be positioned adjacent to a radially inner surface of the engine case. The first direction may be directed from the forward flange toward the aft flange of the outer shroud. The second direction may be directed from the aft flange toward the forward flange of the outer shroud.

A compressor section is also provided. The compressor section may comprise a compressor case and an anti-rotation lug coupled to the compressor case. A vane cluster may include an outer shroud supported within the compressor case. The outer shroud may be configured to receive the anti-rotation lug from first direction. The outer shroud may be configured to block receipt of the anti-rotation lug from a second direction, which is opposite the first direction.

In various embodiments, the outer shroud may comprise a forward flange and an aft flange. The forward flange may define a first slot and wherein the aft flange defines a second slot comprising a tapered opening. The anti-rotation lug may comprise an aft end including a tapered geometry configured to fit into the tapered opening of the second slot. An aft edge of the aft flange may form an aft wall of the second slot. The first direction may be directed from the forward flange toward the aft flange of the outer shroud. The second direction may be directed from the aft flange toward the forward flange of the outer shroud. The vane cluster may further include a plurality of vanes mounted to an inner shroud.

A gas turbine engine is also provided. The gas turbine engine may comprise an engine section comprising at least one of a compressor section or a fan section. The engine section may comprise an engine case and an anti-rotation lug coupled to the engine case. The anti-rotation lug may have a forward end and an aft end. A vane cluster may be supported within the engine case. The vane cluster may include an outer shroud with a first slot defined by a forward flange of the outer shroud and with a second slot defined by an aft flange of the outer shroud. The second slot may be configured to receive the aft end of the anti-rotation lug from first direction. The aft flange may be configured to block receipt of the anti-rotation lug from a second direction, which is opposite the first direction.

In various embodiments, the forward flange may define the first slot. The aft flange may define the second slot comprising a tapered opening. The aft end of the anti-rotation lug may comprise a tapered geometry configured to fit into the tapered opening of the second slot. The first direction may be directed from the forward flange toward the aft flange of the outer shroud. The second direction may be directed from the aft flange toward the forward flange of the outer shroud.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the figures, wherein like numerals denote like elements.

FIGS. 3B, 3C, and 3D illustrate an outer view of a vane cluster for a vane assembly, in accordance with various embodiments;

DETAILED DESCRIPTION

All ranges and ratio limits disclosed herein may be combined. It is to be understood that unless specifically stated otherwise, references to "a," "an," and/or "the" may include one or more than one and that reference to an item in the singular may also include the item in the plural.

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, and mechanical changes may be made without departing from the spirit and scope of the disclosure. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment option. Additionally, any reference to without contact (or similar phrases) may also include reduced contact or minimal contact. Cross hatching lines may be used throughout the figures to denote different parts but not necessarily to denote the same or different materials.

As used herein, "aft" refers to the direction associated with the tail (e.g., the back end) of an aircraft, or generally, to the direction of exhaust of the gas turbine engine. As used herein, "forward" refers to the direction associated with the nose (e.g., the front end) of an aircraft, or generally, to the direction of flight or motion.

As used herein, "distal" refers to the direction radially outward, or generally, away from the axis of rotation of a turbine engine. As used herein, "proximal" refers to a direction radially inward, or generally, towards the axis of rotation of a turbine engine.

Figure 1:
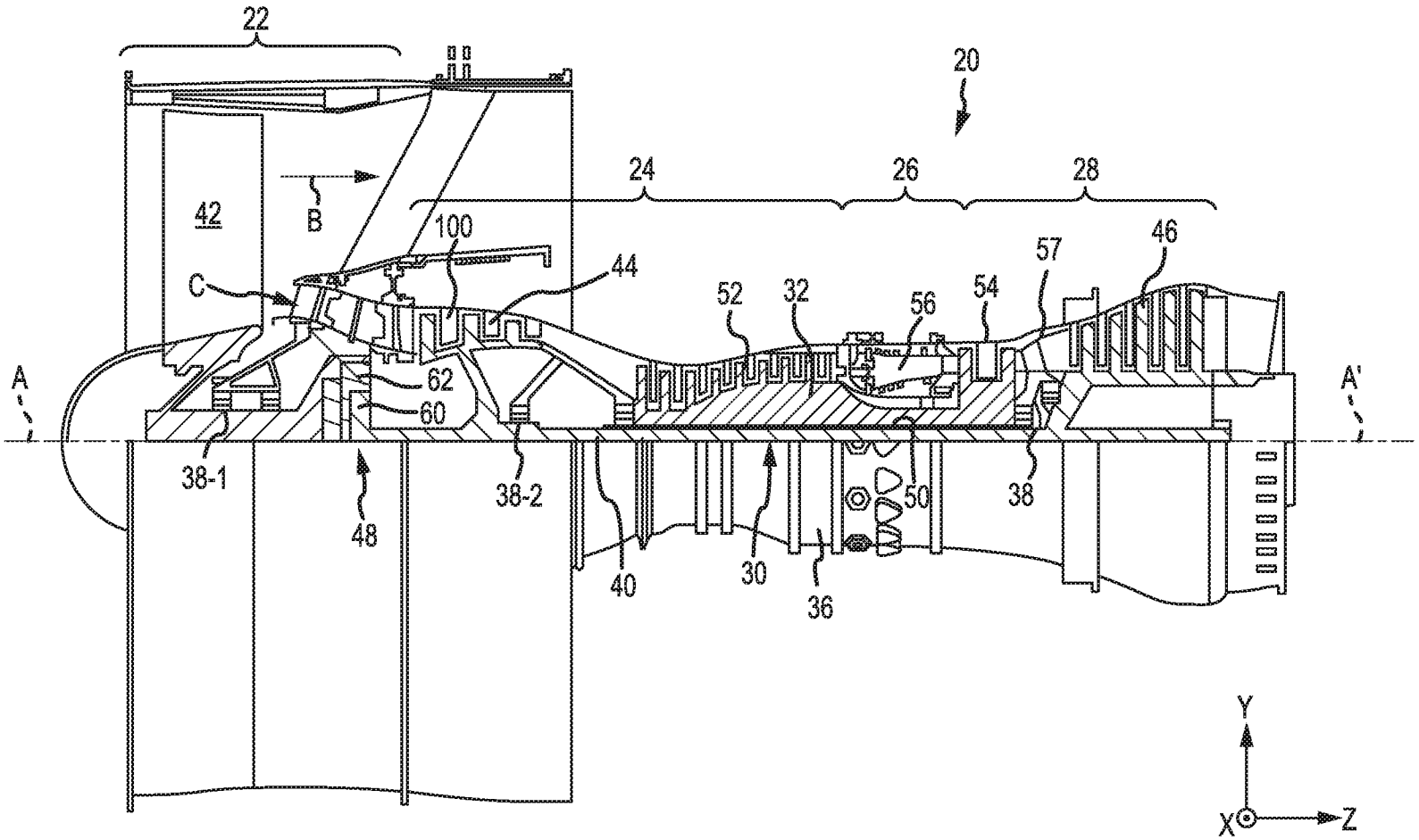
FIG. 1 illustrates a cross-sectional view of an exemplary gas turbine engine, in accordance with various embodiments.

In various embodiments and with reference to FIG. 1, a gas-turbine engine 20 is provided. Gas-turbine engine 20 may be a two-spool turbofan that generally incorporates a fan section 22, a compressor section 24, a combustor section 26 and a turbine section 28. Alternative engines may include, for example, an augmentor section among other systems or features. In operation, fan section 22 can drive coolant along a bypass flow path B while compressor section 24 can drive coolant along a core flow path C for compression and communication into combustor section 26 then expansion through turbine section 28. Although depicted as a turbofan gas-turbine engine 20 herein, it should be understood that the concepts described herein are not limited to use with turbofans as the teachings may be applied to other types of turbine engines including three-spool architectures.

Gas-turbine engine 20 may generally comprise a low speed spool 30 and a high speed spool 32 mounted for rotation about an engine central longitudinal axis A-A' relative to an engine static structure or engine case structure 36 via several bearing systems 38, 38-1, and 38-2. It should be understood that various bearing systems 38 at various locations may alternatively or additionally be provided, including for example, bearing system 38, bearing system 38-1, and bearing system 38-2.

Low speed spool 30 may generally comprise an inner shaft 40 that interconnects a fan 42, a low pressure compressor section 44 and a low pressure turbine section 46. Inner shaft 40 may be connected to fan 42 through a geared architecture 48 that can drive fan 42 at a lower speed than low speed spool 30. Geared architecture 48 may comprise a gear assembly 60 enclosed within a gear housing 62. Gear assembly 60 couples inner shaft 40 to a rotating fan structure. High speed spool 32 may comprise an outer shaft 50 that interconnects a high pressure compressor 52 and high pressure turbine 54. A combustor 56 may be located between high pressure compressor 52 and high pressure turbine 54. A mid-turbine frame 57 of engine case structure 36 may be located generally between high pressure turbine 54 and low pressure turbine 46. Mid-turbine frame 57 may support one or more bearing systems 38 in turbine section 28. Inner shaft 40 and outer shaft 50 may be concentric and rotate via bearing systems 38 about the engine central longitudinal axis A-A', which is collinear with their longitudinal axes. As used herein, a "high pressure" compressor or turbine experiences a higher pressure than a corresponding "low pressure" compressor or turbine.

The core airflow C may be compressed by low pressure compressor 44 then high pressure compressor 52, mixed and burned with fuel in combustor 56, then expanded over high pressure turbine 54 and low pressure turbine 46. Turbines 46, 54 rotationally drive the respective low speed spool 30 and high speed spool 32 in response to the expansion.

Gas-turbine engine 20 may be, for example, a high-bypass ratio geared aircraft engine. In various embodiments, the bypass ratio of gas-turbine engine 20 may be greater than about six (6). In various embodiments, the bypass ratio of gas-turbine engine 20 may be greater than ten (10). In various embodiments, geared architecture 48 may be an epicyclic gear train, such as a star gear system (sun gear in meshing engagement with a plurality of star gears supported by a carrier and in meshing engagement with a ring gear) or other gear system. Geared architecture 48 may have a gear reduction ratio of greater than about 2.3 and low pressure turbine 46 may have a pressure ratio that is greater than about five (5). In various embodiments, the bypass ratio of gas-turbine engine 20 is greater than about ten (10:1). In various embodiments, the diameter of fan 42 may be significantly larger than that of the low pressure compressor 44, and the low pressure turbine 46 may have a pressure ratio that is greater than about five (5:1). Low pressure turbine 46 pressure ratio may be measured prior to inlet of low pressure turbine 46 as related to the pressure at the outlet of low pressure turbine 46 prior to an exhaust nozzle. It should be understood, however, that the above parameters are exemplary of various embodiments of a suitable geared architecture engine and that the present disclosure contemplates other turbine engines including direct drive turbofans. A gas turbine engine may comprise an industrial gas turbine (IGT) or a geared aircraft engine, such as a geared turbofan, or non-geared aircraft engine, such as a turbofan, a turboshaft, or may comprise any gas turbine engine as desired.

In various embodiments, an engine section, such as fan section 22, compressor section 24 and/or turbine section 28, may comprise one or more stages or sets of rotating blades and one or more stages or sets of stationary vanes axially interspersed with the associated blade stages but non-rotating about engine central longitudinal axis A-A'. For example, the rotor assemblies may carry a plurality of rotating blades, while each vane assembly 100 may carry a plurality of vanes that extend into the core flow path C. The blades may rotate about engine central longitudinal axis A-A', while the vanes may remain stationary about engine central longitudinal axis A-A'. The blades may create or extract energy (in the form of pressure) from the core airflow that is communicated through the engine section along the core flow path C. The vanes may direct the core airflow to the blades to either add or extract energy. A plurality of vane assemblies 100 may be disposed throughout the core flow path C to impart desirable flow characteristics on the gas flowing through the core flow path C. Vane assemblies 100 may at least one row of vanes arranged circumferentially about the engine central longitudinal axis A-A'.

Figure 2:
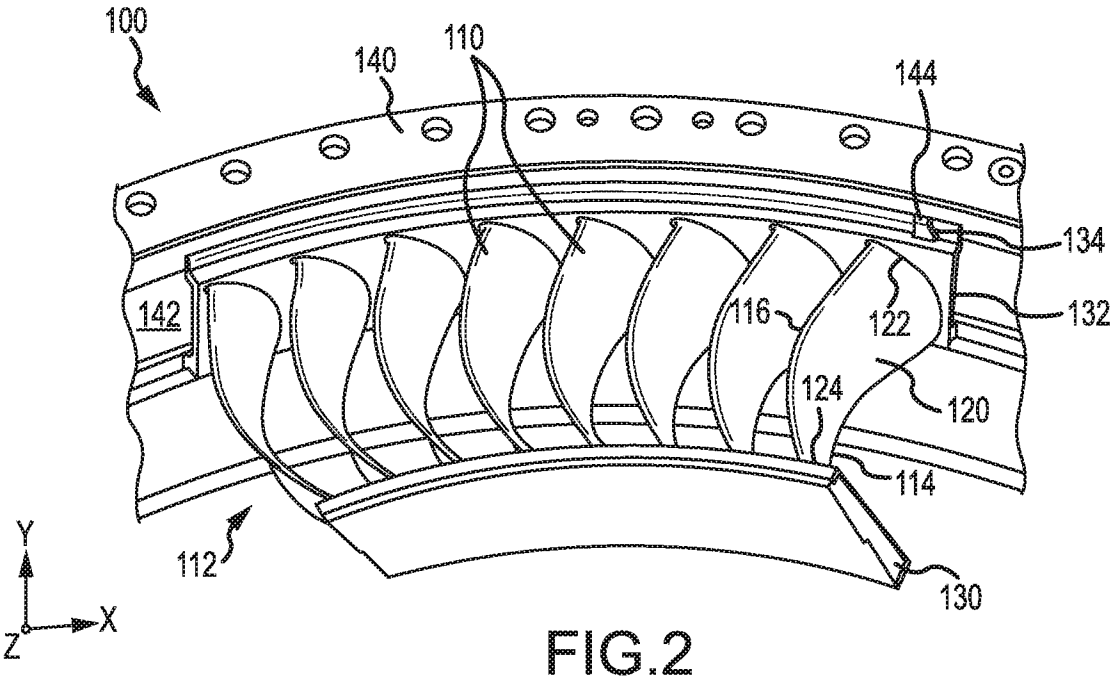
FIG. 2 illustrates a fragmentary perspective view of a vane assembly of a gas turbine engine, in accordance with various embodiments.

Referring to FIGS. 1 and 2, a vane assembly 100 may include a plurality of vanes 110, which may be arranged into subassemblies or vane clusters 112. A vane assembly 100 may include a partial or a complete circumferential array of vanes 110. In various embodiments, vane assembly 100 may comprise a continuous annular vane assembly or a plurality of vane clusters 112. In various embodiments, each vane 110 may be a separate component from each adjacent vane 110. Vanes 110 may be grouped into vane clusters 112 and arranged circumferential about engine central longitudinal axis A-A' to provide the vane assembly 100. Vanes 110 and/or vane clusters 112 may be mounted in circumferentially abutting relationship to form an annular ring.

With reference now to FIG. 2, a portion of a vane assembly 100 of FIG. 1 is shown, in accordance with various embodiments. Each of the vanes 110 may comprise a leading edge 114 and a trailing edge 116. Leading edge 114 and trailing edge 116 may be configured to direct airflow through gas-turbine engine 20. A vane 110 may comprise, for example, an airfoil body 120. Vane 110 may comprise a radially outer end 122 and a radially inner end 124 with airfoil body 120 extending between radially outer end 122 and radially inner end 124. Radially outer end 122 may be a distal end of vane 110. Radially inner end 124 may be a proximal end of vane 110. A distance between radially outer end 122 and radially inner end 124 may, for example, comprise a span of airfoil body 120.

In various embodiments, each vane 110 of vane assembly 100 may be circumferentially retained to the engine at an outer diameter and/or an inner diameter of the vane assembly 100. Vanes 110 may be cantilevered with an attachment point at radially inner end 124 or at radially outer end 122. A radially inner end 124 of vane 110 may couple to an inner shroud 130. Vane assembly 100 may include an inner shroud 130, which may be an inner circumferential fixed structure comprised of one or more segments. In various embodiments, a plurality of vanes 110 may be coupled to a segment of inner shroud 130 to form a vane cluster 112. Radially outer end 122 of vane 110 may couple an outer shroud 132. In various embodiments, vane 110 may be integral with a portion of inner shroud 130 or outer shroud 132. For example, each vane 110 may include a discrete portion of outer shroud 132 integral with the vane 110. Thus, each vane cluster 112 may include a plurality of vanes 110 forming a portion of outer shroud 132, and vanes 110 of the vane cluster 112 may be coupled to a segment of inner shroud 130.

In various embodiments, one or more vane clusters 112 are disposed within and supported by an engine case 140. Engine case 140 may be an aft case of a compressor, i.e., a compressor case, for example. Engine case 140 may have an annular geometry configured to receive a plurality of vane clusters 112 positioned adjacent to a radially inner surface 142 of engine case 140. Vane cluster 112 may be slidably received within engine case 140. An anti-rotation lug 144 may interface with outer shroud 132 to prevent undesired circumferential movement or rotation of vane clusters 112 relative to engine case 140. Anti-rotation lug 144 may fit into a slot 134 in outer shroud 132. Slot 134 and anti-rotation lug 144 may be configured with an installation feature, as described herein.

Figure 3A:
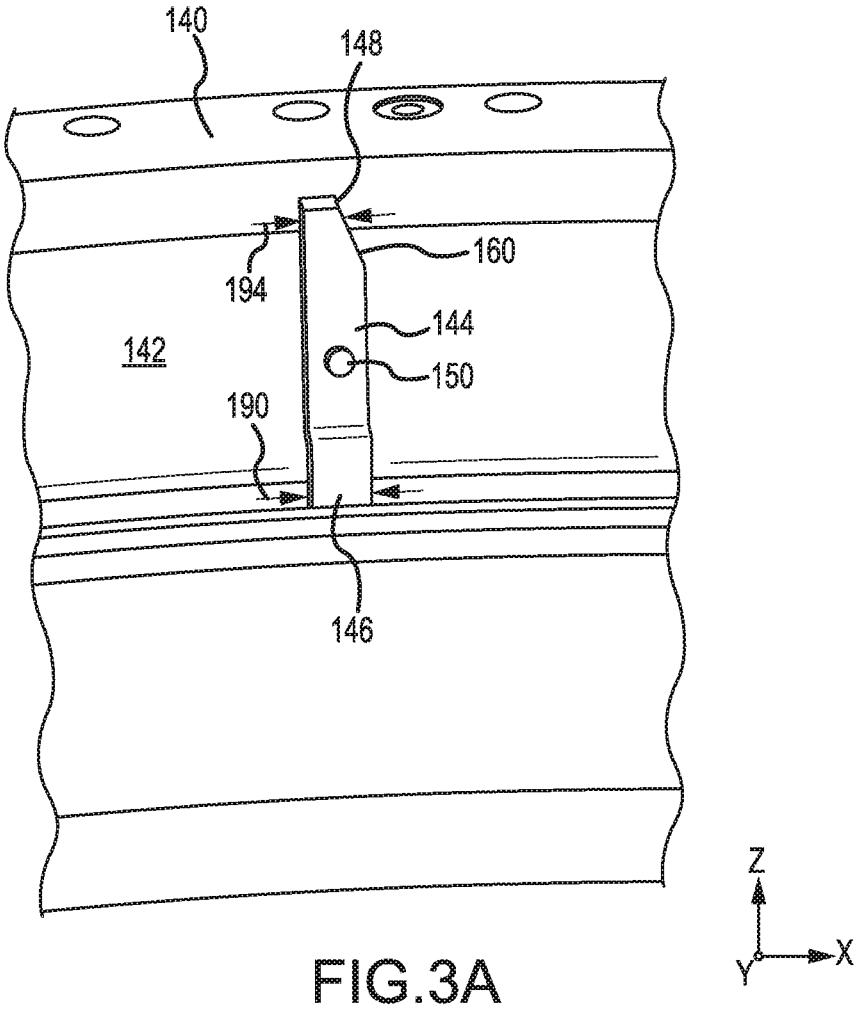
FIG. 3A illustrates an inner surface of an engine case of a vane assembly, in accordance with various embodiments.

With reference now to FIG. 3A, an engine case 140 including an anti-rotation lug 144 is shown, in accordance with various embodiments. Anti-rotation lug 144 may be coupled to radially inner surface 142 of engine case 140, for example, by a fastener 150. Fastener 150 may include a bolt, washer, pin, screw, rivet or other suitable fastener for mechanically coupling anti-rotation lug 144 to engine case 140. In various embodiments, anti-rotation lug 144 may be fixedly attached to or integrally formed with engine case 140.

Anti-rotation lug 144 may be positioned on engine case 140 to extend in the axial direction (z direction) and may terminate in a forward end 146 and an aft end 148. A geometry or shape of forward end 146 of anti-rotation lug 144 may be dissimilar to a geometry or shape of aft end 148 of anti-rotation lug 144. In various embodiments, aft end 148 of anti-rotation lug 144 may include a tapered surface 160, while forward end 146 of anti-rotation lug 144 may comprise a generally square, or non-tapered, geometry.

Figure 3B:
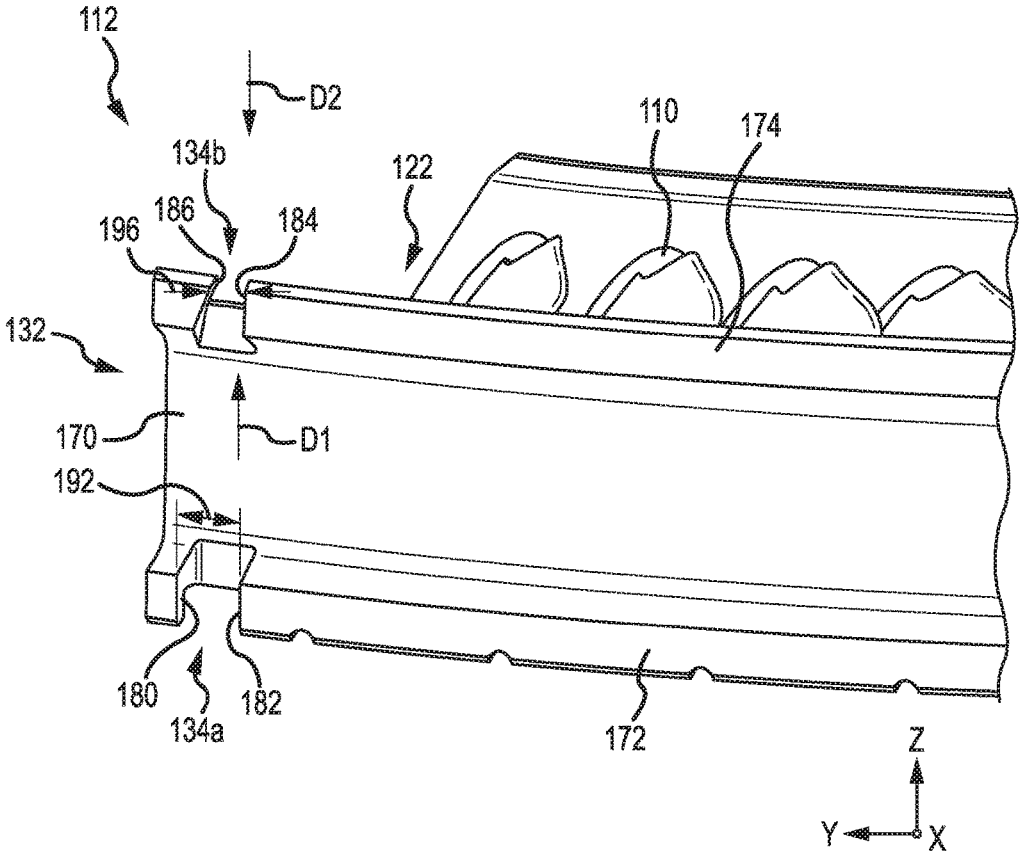

With reference to FIG. 3B, a portion of a vane cluster 112 is shown, in accordance with various embodiments. Vane cluster 112 may include an outer shroud 132 disposed at a radially outer end 122 of vanes 110. Outer shroud 132 may include a platform 170 with a forward flange 172 and an aft flange 174 extending from platform 170. Forward flange 172 may extend axially forward (i.e., in the negative z direction) from platform 170 and may define a first slot 134*a*. First slot 134*a* may extend into forward flange 172 and may have sidewalls 180, 182 which may be substantially parallel. Aft flange 174 may extend axially aft (i.e., in the positive z direction) from platform 170 and may define a second slot 134*b*. Second slot 134*b* may extend into aft flange 174 and may have sidewalls 184, 186, which may be non-parallel. Second slot 134*b* may comprise a tapered opening, which narrows toward an aft end of second slot 134*b*.

Referring now to FIGS. 3A and 3B, an installation feature for a vane assembly may include anti-rotation lug 144, which interfaces with slots 134*a*, 134*b* in outer shroud 132. Slots 134*a*, 134*b* may be configured with complementary geometry to anti-rotation lug 144. First slot 134*a* may have a similar width and similar geometry as forward end 146 of anti-rotation lug 144. For example, a width 190 of forward end 146 (FIG. 3A) may be similar to a width 192 of first slot 134*a* (FIG. 3B), wherein width 192 is a distance between sidewall 180 and sidewall 182. First slot 134*a* may have a width 192 that is greater than a width 194 of aft end 148, such that aft end 148 may slide through first slot 134*a* during assembly. Second slot 134*b* may have a similar width and similar geometry as aft end 148 of anti-rotation lug 144. For example, a width 196 of second slot 134*b* (FIG. 3B) may be similar to a width 194 of aft end 148 (FIG. 3A). Second slot 134*b* may be configured to receive anti-rotation lug 144 from a first direction D1, wherein the first direction D1 is directed from the forward flange 172 toward the aft flange 174 of outer shroud 132. Second slot 134*b* may further be configured to block receipt of anti-rotation lug 144 from a second direction D2, which is opposite to first direction D1, wherein "opposite to first direction D1" in this context only means 180 degrees opposed to first direction D1, +/−5 degrees. The direction D2 may be directed from aft flange 174 toward forward flange 172 of outer shroud 132 (i.e., in the negative z direction).

With reference to FIG. 3C, a portion of a vane cluster 212 including an outer shroud 232 having an installation feature is shown in accordance with various embodiments. Vane cluster 212 may include a plurality of vanes 210 coupled to an outer shroud 232. Outer shroud 232 may include a platform 270 with a forward flange 272 and an aft flange 274 extending from platform 270. Forward flange 272 may include a first slot 234*a*, which may have sidewalls that are substantially parallel. Aft flange 274 may include a second slot 234*b*, which extends in an axial direction (z direction) partially, but not completely, through aft flange 274. An aft edge 236 of aft flange 274 may form an aft wall of second slot 234*b*. A vane assembly may include an anti-rotation lug with a geometry complementary to the shape and size of slots 234*a*, 234*b*. The aft edge 236 of aft flange 274 blocks an anti-rotation lug from being inserted through aft flange 274, thereby preventing vane cluster 212 from being installed backward into an engine case, i.e., with an aft edge positioned forward.

With reference to FIG. 3D, a portion of a vane cluster 312 including an outer shroud 332 having an installation feature is shown in accordance with various embodiments. Vane cluster 312 may include a plurality of vanes 310 coupled to an outer shroud 332. Outer shroud 332 may include a platform 370 with a forward flange 372 and an aft flange 374 extending from platform 370. Forward flange 372 may include a first slot 334, which may have sidewalls that are substantially parallel. Aft flange 374 may not include a slot, and thus aft flange 374 may not receive an anti-rotation lug, such as anti-rotation lug 144 from FIG. 3A. A vane assembly may include an anti-rotation lug configured to fit through first slot 334. An anti-rotation lug may be configured with a geometry complementary to the shape and size of first slot 334. Without an aft slot, aft flange 374 prevents an anti-rotation lug from being inserted through aft flange 374, thereby preventing vane cluster 312 from being installed backward into an engine case, i.e., with an aft edge positioned forward.

Figure 4:
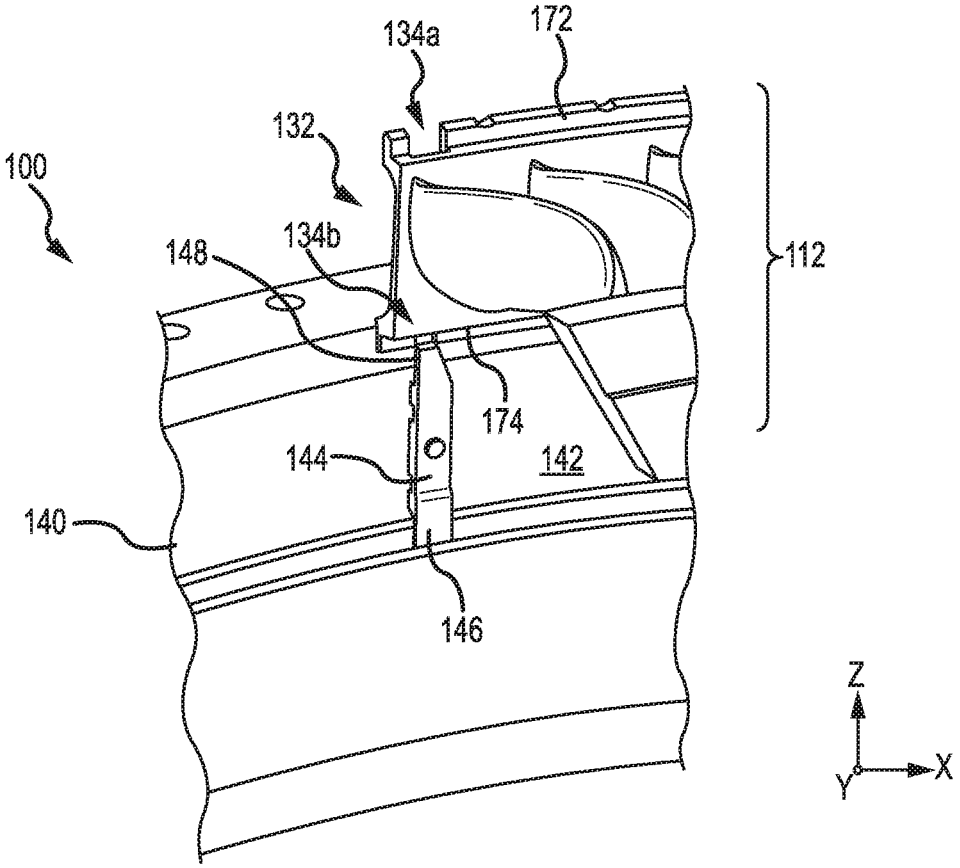
FIG. 4 illustrates an installation feature of a vane assembly, in accordance with various embodiments.

Referring to FIG. 4, a portion of a vane assembly 100 including an installation feature is shown in accordance with various embodiments. Anti-rotation lug 144 is configured to interface with outer shroud 132, such that vane cluster 112 is prevented from being installed backwards, i.e., with aft flange 174 positioned forward (negative z direction) relative to forward flange 172. A width of second slot 134*b* may be less than a width of anti-rotation lug 144. As shown in FIG. 4, second slot 134*b* of aft flange 174 includes a narrow opening that does not receive anti-rotation lug 144 if vane cluster 112 is installed in the wrong direction. Second slot 134*b* is configured to receive the aft end 148 of anti-rotation lug 144 in a first direction, while aft flange 174 is configured to block receipt of the anti-rotation lug 144 in a second direction (shown), which is opposite the first direction. Thus, a width of second slot 134*b* is configured to prevent improper installation of vane cluster 112.

Figure 5:
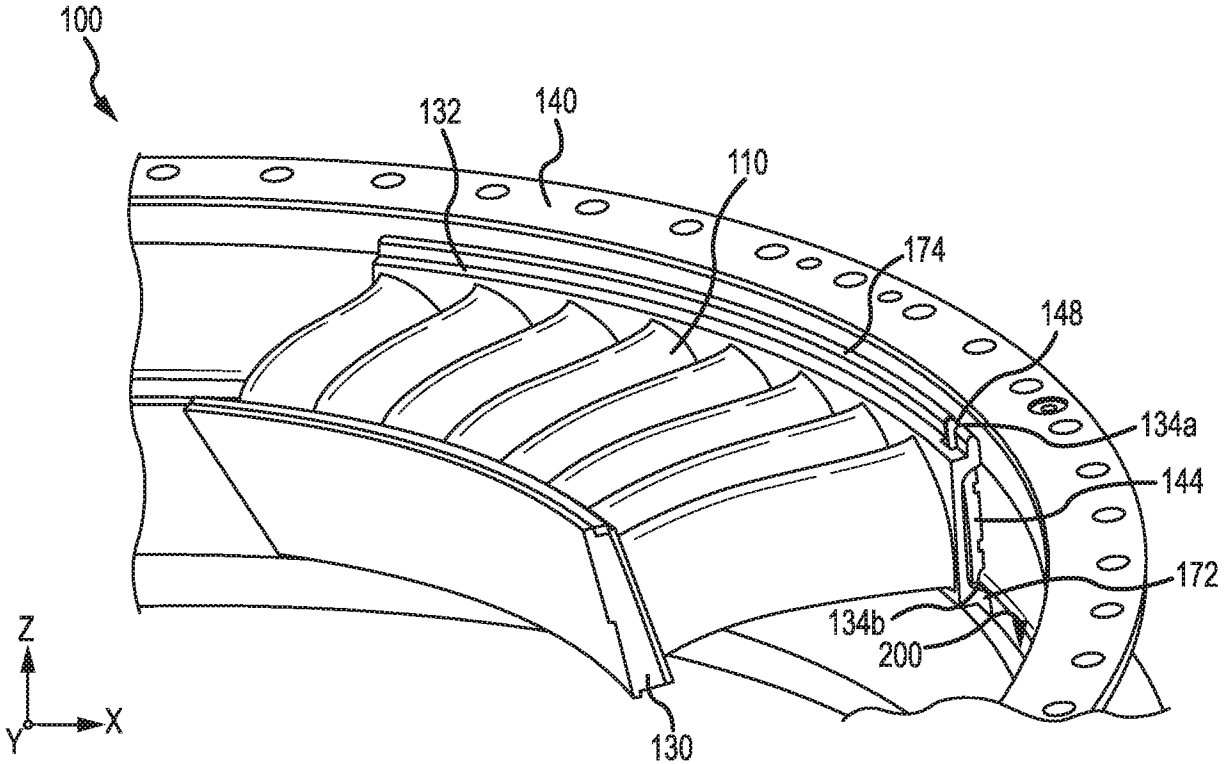
FIG. 5 illustrates a fragmentary perspective view of a vane assembly of a gas turbine engine, in accordance with various embodiments.

Referring to FIG. 5, a portion of a vane assembly 100 with a vane cluster 112 installed within engine case 140 is shown in accordance with various embodiments. Where first slot 134*a* in forward flange 172 is oriented in a forward direction assembly (negative z direction), vane cluster 112 may be slidably received within engine case 140. Vane cluster 112 may be configured to interface with an engine case 140 via forward flange 172, wherein engine case 140 is disposed radially outward or distal to vane cluster 112. Forward flange 172 may be configured to couple within one or more slots 200 defined within engine case 140. Vane assembly 100 may receive a plurality of vane clusters 112 within engine case 140 and may include one or more anti-rotation lugs 144. Each vane cluster 112 may be configured to receive an anti-rotation lug 144 from first direction, such as with forward flange 172 oriented in a forward direction with respect to vane cluster 112 within engine case 140. Aft flange 174 may be configured to block receipt of anti-rotation lug 144 from a second direction, such as with forward flange 172 oriented in an aft direction with respect to vane cluster 112 within engine case 140. Engine case 140 provides the support for the vane cluster 112 such that loads on vane cluster 112 transfer to the engine case 140.

Figure 6:
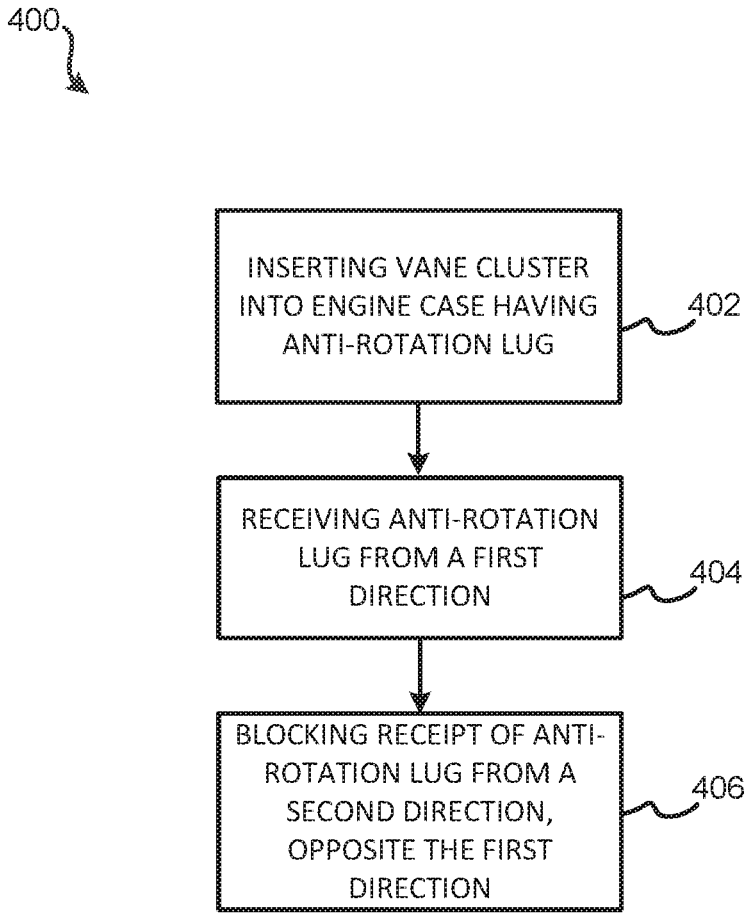
FIG. 6 illustrates a method installing a vane cluster, in accordance with various embodiments.

With reference to FIG. 6, a method 400 for installing a vane cluster is shown in accordance with various embodiments. Method 400 may comprise the steps of inserting a vane cluster into an engine case having an anti-rotation lug (step 402), receiving, by the vane cluster, the anti-rotation lug from a first direction (step 404), blocking receipt of the anti-rotation lug from a second direction, which is opposite the first direction (step 406).

Benefits and other advantages have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, and any elements that may cause any benefit or advantage to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A vane assembly, comprising:

an engine case;

an anti-rotation lug coupled to the engine case, the anti-rotation lug having a forward end comprising a non-tapered geometry and an aft end comprising a tapered geometry, wherein the anti-rotation lug is at least one of integrally formed with the engine case or attached to the engine case via a fastener; and a vane cluster supported within the engine case, wherein the vane cluster includes an outer shroud and a plurality of vanes coupled to the outer shroud, the outer shroud comprising a first slot defined by a forward flange of the outer shroud and a second slot defined by an aft flange of the outer shroud;

wherein a geometry of the second slot is complementary to the tapered geometry of the aft end of the anti-rotation lug and a width of the second slot decreases in a forward to aft direction, and wherein the geometry and the width of the second slot allow the aft end of the anti-rotation lug to be inserted into the second slot from a first axial direction and block the aft end of the anti-rotation lug from being inserted into the second slot from a second axial direction, which is opposite the first axial direction.

2. The vane assembly of claim 1, wherein the width of the second slot at an aft end of the second slot is less than a width of the first slot.

3. The vane assembly of claim 1, wherein an aft edge of the aft flange forms an aft wall of the second slot, wherein the aft wall extends radially outward from a radially inward floor of the second slot and circumferentially between a first sidewall and a second sidewall of the second slot.

4. The vane assembly of claim 1, wherein the vane cluster is positioned adjacent to a radially inner surface of the engine case.

5. The vane assembly of claim 1, wherein the first axial direction is directed from the forward flange toward the aft flange of the outer shroud.

6. The vane assembly of claim 1, wherein the second axial direction is directed from the aft flange toward the forward flange of the outer shroud.

7. A compressor section, comprising:

a compressor case;

an anti-rotation lug coupled to the compressor case, wherein the anti-rotation lug is at least one of integrally formed with the compressor case or attached to the compressor case via a fastener, the anti-rotation lug having a forward end comprising a non-tapered geometry and an aft end comprising a tapered geometry; and a vane cluster including an outer shroud and a plurality of vanes coupled to the outer shroud, the outer shroud including a forward flange and an aft flange, wherein the outer shroud is supported within the compressor case, and wherein the forward flange defines a first slot and the aft flange defines a second slot;

wherein a geometry of the second slot is complementary to the tapered geometry of the aft end of the anti-rotation lug and a width of the second slot decreases in a forward to aft direction, and wherein the geometry and the width of the second slot allow the aft end of the anti-rotation lug to be inserted into the second slot from a first axial direction and block the aft end of the anti-rotation lug from being inserted into the second slot from a second axial direction, which is opposite the first axial direction.

8. The compressor section of claim 7, wherein an aft edge of the aft flange forms an aft wall of the second slot, wherein the aft wall extends radially outward from a radially inward floor of the second slot and circumferentially between a first sidewall and a second sidewall of the second slot.

9. The compressor section of claim 7, wherein the first axial direction is directed from the forward flange toward the aft flange of the outer shroud.

10. The compressor section of claim 9, wherein the second axial direction is directed from the aft flange toward the forward flange of the outer shroud.

11. The compressor section of claim 7, wherein the vane cluster further includes an inner shroud mounted to the plurality of vanes.

12. A gas turbine engine, comprising:

an engine section comprising at least one of a compressor section or a fan section, the engine section comprising:

an engine case, an anti-rotation lug coupled to the engine case, the anti-rotation lug having a forward end comprising a non-tapered geometry and an aft end comprising a tapered geometry, and a vane cluster supported within the engine case, wherein the vane cluster includes an outer shroud, the outer shroud comprising a first slot defined by a forward flange of the outer shroud and a second slot defined by an aft flange of the outer shroud, wherein a geometry of the second slot is complementary to the tapered geometry of the aft end of the anti-rotation lug, and wherein the geometry of the second slot allows the aft end of the anti-rotation lug to be inserted into the second slot from a first axial direction and blocks the aft end of the anti-rotation lug from being inserted into the second slot from a second axial direction, which is opposite the first axial direction.

13. The gas turbine engine of claim 12, wherein the second slot comprises a tapered opening that narrows toward an aft end of the second slot.

14. The gas turbine engine of claim 13, wherein an aft edge of the aft flange forms an aft wall of the second slot, wherein the aft wall extends radially outward from a radially inward floor of the second slot and circumferentially between a first sidewall and a second sidewall of the second slot.

15. The gas turbine engine of claim 12, wherein the first axial direction is directed from the forward flange toward the aft flange of the outer shroud and wherein the second axial direction is directed from the aft flange toward the forward flange of the outer shroud.

* * * * *